US005781167A

United States Patent [19]

Rebeschi et al.

[11] Patent Number: 5,781,167

[45] Date of Patent: Jul. 14, 1998

[54] ANALOG VIDEO INPUT FLAT PANEL DISPLAY INTERFACE

[75] Inventors: Thomas J. Rebeschi, North Haven; Russell A. Budzilek, Bridgeport, both of Conn.

[73] Assignee: Northrop Grumman Corporation, Los Angeles, Calif.

[21] Appl. No.: 626,895

[22] Filed: Apr. 4, 1996

[51] Int. Cl.[6] ..... G09G 3/30

[52] U.S. Cl. ..... 345/76; 345/79

[58] Field of Search ..... 345/36, 76–80; 345/207, 79, 96, 77, 147, 208, 209, 210; 315/169.1, 169.3

[56] References Cited

U.S. PATENT DOCUMENTS

| | | | |
|---|---|---|---|
| 4,443,741 | 4/1984 | Tanaka et al. | 345/78 |
| 4,481,511 | 11/1984 | Hanmura et al. | 345/100 |
| 5,093,654 | 3/1992 | Swift et al. | 345/76 |
| 5,170,155 | 12/1992 | Plus et al. | 345/104 |
| 5,270,697 | 12/1993 | Takeda | 345/96 |
| 5,426,447 | 6/1995 | Lee | 345/103 |
| 5,517,207 | 5/1996 | Kawada et al. | 345/78 |
| 5,550,557 | 8/1996 | Kapoor et al. | 345/212 |
| 5,570,105 | 10/1996 | Koyama | 345/147 |
| 5,602,561 | 2/1997 | Kawaguchi et al. | 345/89 |

FOREIGN PATENT DOCUMENTS

| | | | |
|---|---|---|---|
| 2161306 | 8/1986 | United Kingdom | 345/79 |

*Primary Examiner*—Xiao Wu

*Attorney, Agent, or Firm*—Walter G. Sutcliff

[57] ABSTRACT

A method and apparatus for providing a column driver circuit for an electroluminescent display panel including a column driver with a column driver including a direct analog interface with an input buffer with an input for accepting an external analog signal and an output for outputting an analog signal for said electroluminescent display panel. The buffer includes a polarity inverter and an adder for selectively inverting the external analog signal and adding a DC voltage. The column driver further includes an output demultiplexer, a plurality of sample and hold circuits, and an output driver employing negative feedback techniques for comparing the feedback signal to a preselected external variable voltage and selecting the appropriate drive signal.

10 Claims, 7 Drawing Sheets

FIG. 2
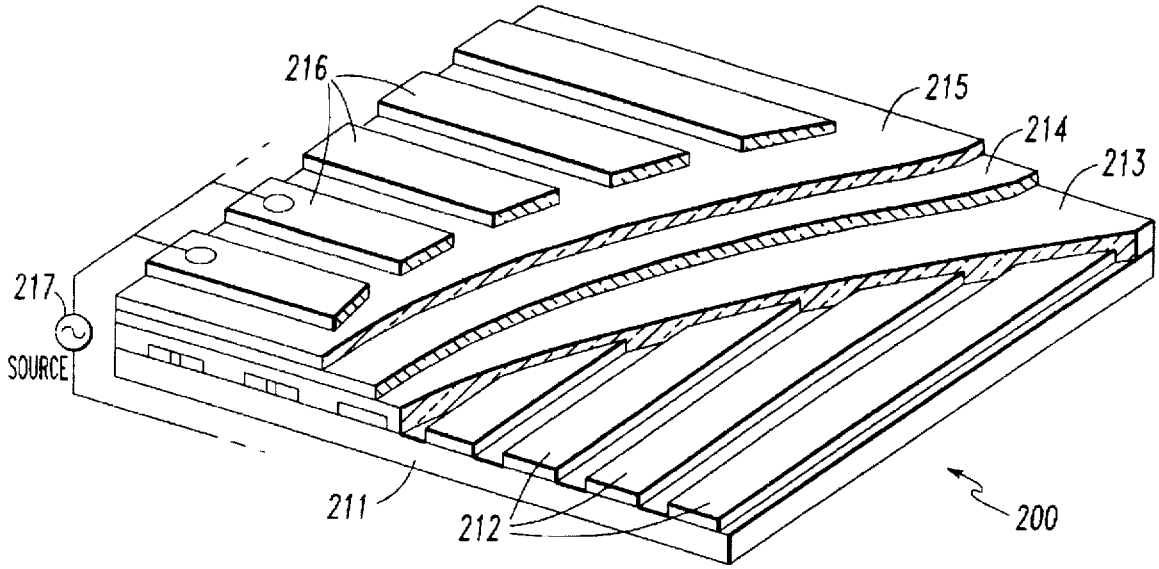
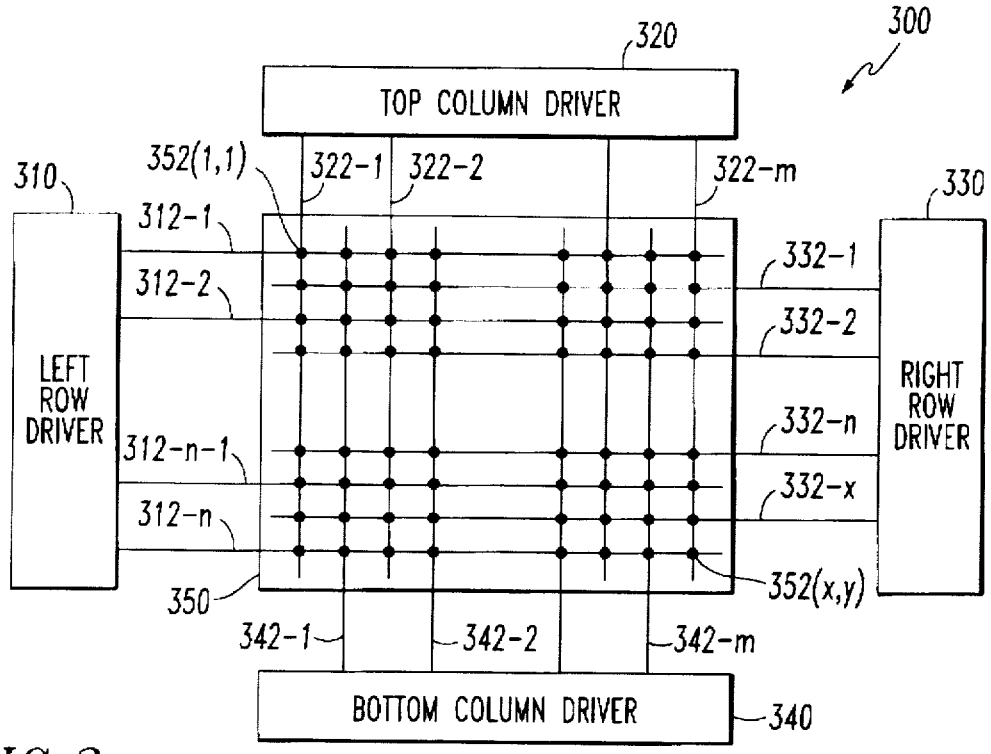
FIG. 3

ANALOG VIDEO INPUT FLAT PANEL DISPLAY INTERFACE

BACKGROUND OF THE INVENTION

1. Field of the Invention

The present invention relates to apparatus and a method for thin-film electroluminescent panels and more particularly to related drive circuitry therefore. This application is related to application U.S. Ser. No. 08/626,897 entitled, "High Performance, Low Cost Helmet Mounted Display", Dominick L. Monarchie et al., filed concurrently and application U.S. Ser. No. 08/626,898 entitled, "Symmetric Row Drive For An Electroluminescent Display", Mohan L. Kapoor et al., filed concurrently, whose specifications are hereby incorporated by reference.

2. Description of the Related Art

Electroluminescence (EL) is the emission of light from a phosphor due to the application of an electric field.

A typical thin-film electroluminescent (TFEL) display panel comprises a matrix-addressed panel of a thin-film phosphor in a thin-film dielectric sandwich. The thin-film phosphor emits light when a large enough electric field is applied across it. The electric field typically is provided by an electrode matrix that comprises a plurality of row electrodes and a plurality of orthogonally positioned column electrodes. The intersections of the row electrodes with the column electrodes define pixel cells. The pixel cells comprise the pixels of the TFEL display. When a voltage having a sufficient magnitude is applied between a row electrode and a column electrode, the phosphor of the pixel cell at the intersection will emit light. The magnitude of the voltage required to cause the phosphor to emit light is the threshold voltage.

In operation, a write voltage pulse is applied to the row electrodes, one row at a time (e.g., row one, followed by row two, and so forth). The write voltage pulse applied to the "addressed" row electrode (e.g., the first row) is below the threshold and is thus insufficient by itself to cause the phosphors of the first row to emit light. At the same time that the write voltage pulse is applied to the selected row electrode, a modulation voltage pulse is applied to each column electrode. If the difference between the modulation voltage pulse applied to the column and the write voltage pulse applied to the row exceeds the threshold voltage for the phosphor, then the pixel cell emits light. The intensity of the light may be controlled by varying the column voltage thus controlling the darkness of the resultant grey-scale pixel.

After the first row has been written, the write voltage pulse is applied to the next row (e.g., row two), and a modulation voltage pulse is applied to each column to cause the phosphors of selected pixel cells in the second row to emit light. The sequence is repeated for each row until an entire frame has been written.

Flat panel displays may be used for small, high resolution displays that reduce the size of the display but require the same amount of circuitry to drive the display. The packaging of the display drivers has been reduced with high density integrated circuits, but the corresponding interface circuits have yet to be adequately addressed.

A typical Thin Film Electroluminescent Display requires a column driver configuration 100 as illustrated in FIG. 1. Today's video cameras are largely based on Charge Coupled Device (CCD) technology. Analog video output (not shown) from a CCD device is usually digitized in an analog to digital (A/D) converter (not shown), delivered to input 101-1 of shift register 102-1, transmitted to data latch 106-1 under control of control data lines 104-1. The digital signal is then sent to comparator 108-1, where it is compared to a predetermined signal, latched and sent to D/A converter 110-1 for conversion to an analog signal, adjusted to the appropriate analog level in level shifter 112-1 before input to output stage 114-1 for driving an analog display.

The drawback of such systems include the required high frequency expensive A/D and D/A circuitry with the corresponding introduction of quantization errors resulting in resolution degradation. Additionally, such column drivers are relatively heavy, bulky and require relatively high power.

A need exists for lightweight portable display devices and accompanying lightweight, low power and compact display drivers for use in helmet mounted displays and other types of portable displays that reduce complexity by using a direct analog addressing method.

It is desirable to solve or ameliorate one or more of the above-described problems in the instant invention.

SUMMARY OF THE INVENTION

In the broadest sense, our invention rests upon our ability to provide a relatively low cost, portable, low complexity, low power column driver for an electroluminescent display.

According to a preferred embodiment of the invention, the invention is directed to a driver circuit for an electroluminescent display panel comprising a column driver including a direct analog interface with an input buffer, the buffer including a polarity inverter and an adder for selectively inverting the external analog signal and adding a DC voltage.

It further includes a driver circuit for an electroluminescent display panel further including a means for output demultiplexing and a plurality of means for sampling and holding a signal, means for comparing an input from the means for sampling and holding to a predetermined variable waveform and means for outputting a compared difference voltage to an analog display output.

Additionally provided is a negative feedback loop for supplying a negative feedback signal from an output terminal of the means for comparing to an input terminal of the means for comparing.

Further features of the above-described intermediate frequency partitioning plan will become apparent from the detailed description hereinafter.

The foregoing features together with certain other features described hereinafter enable the overall system to have properties differing not just by a matter of degree from the any related art, but offering an order of magnitude more efficient use of already existing circuitry.

Additional features and advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate preferred embodiments of the apparatus and method according to the invention and, together with the description, serve to explain the principles of the invention.

BRIEF DESCRIPTION OF THE DRAWINGS

FIG. 2 illustrates a Thin Film Electroluminescent Display Panel of the present invention.

FIG. 3 illustrates a Row-Column Driver configuration of the present invention.

DETAILED DESCRIPTION

Figure 1:
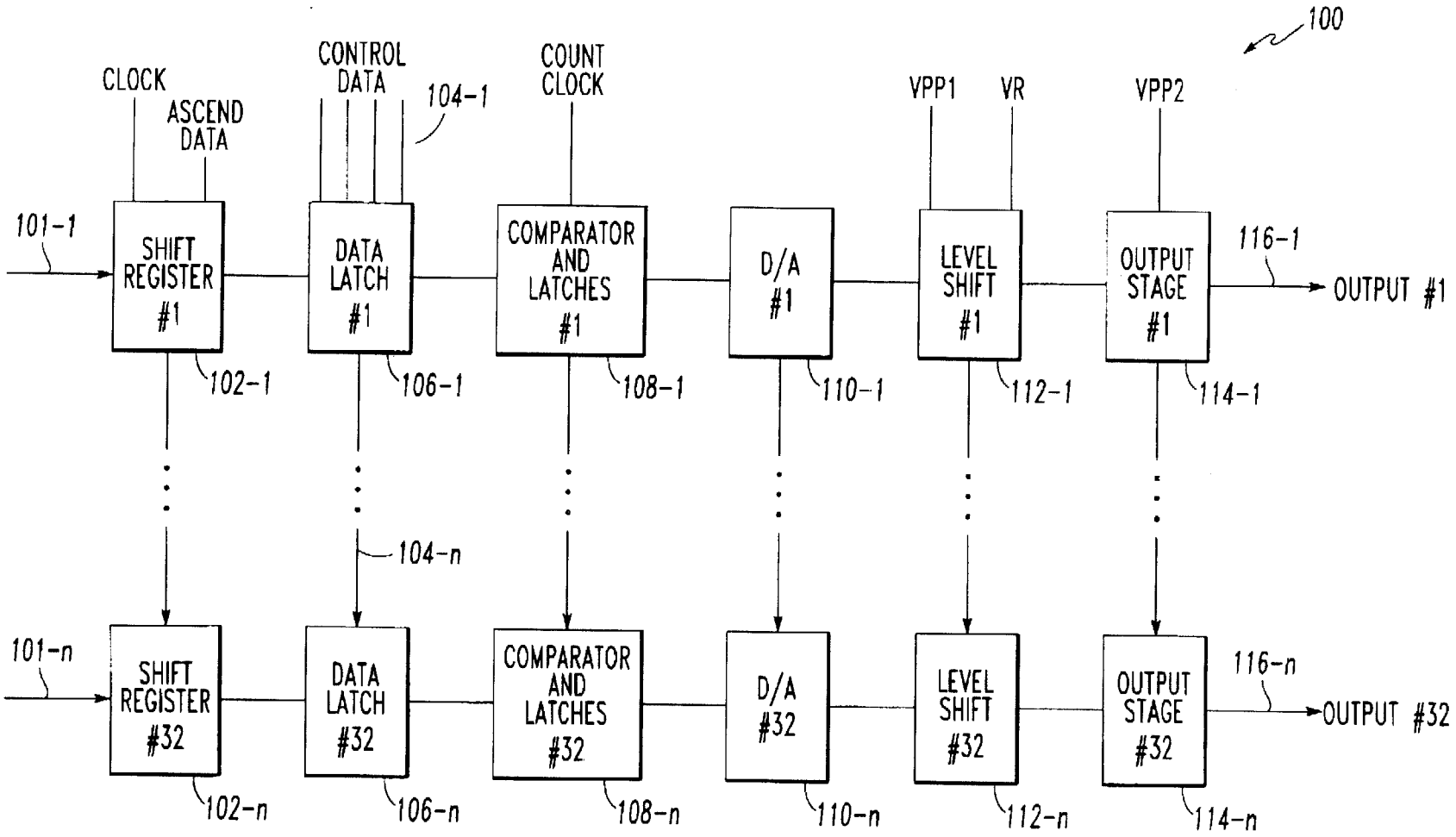
FIG. 1 PRIOR ART
FIG. 1 illustrates a conventional Column Drive Block Diagram.

A typical TFEL structure is constructed from the front (viewing) side to the rear. The thin layers are sequentially deposited on a suitable substrate. Glass substrates are utilized to provide transparency. The transparent front electrodes are typically made from Indium Tin Oxide (ITO) and are deposited on the glass substrate by conventional means, typically by sputtering. The subsequent dielectric-phosphor-dielectric layers are then usually deposited by standard means, again typically by sputtering or evaporation. The phosphor layer is usually annealed after deposition to improve efficiency. The rear electrode may be then added. The finished TFEL laminate is encapsulated in order to protect it from external humidity. Epoxy laminated cover glass or silicon oil encapsulation are used. In that the initial substrate used for deposition is typically glass, the materials and deposition techniques employed in TFEL laminate construction cannot demand high temperature processing.

Referring now to FIG. 2, a thin film electroluminescent (TFEL) display panel 200 includes a glass substrate 211, a plurality of transparent electrodes 212, a first layer of insulating material 213, a layer of electroluminescent material 214, a second layer of insulating material 215 and a plurality of rear electrodes 216. The glass substrate 211 is preferably a borosilicate glass such as CORNING 7059 available from Corning Glassworks of Corning, N.Y. Each of the plurality of transparent electrodes 212 is preferably indium-tin-oxide (ITO) in a preferred embodiment of the present invention and each of the plurality of rear electrodes is Aluminum (Al). The insulating layers 213, 215 include a dielectric material and each layer acts as a capacitor to protect the electroluminescent material 214 from high direct electrical DC currents. The electroluminescent material is typically ZnS doped with Mn.

When a voltage source 217 applies a voltage signal across electrodes 212, 216 respectively, electrons flow and tunnel through layers 213–215 between electrodes 212, 216. These flowing electrons excite the Mn in the electroluminescent material such that the Mn emits photons which pass through both first insulating layer 213 and transparent electrodes 212 to form an image on glass substrate 211 when the magnitude of the voltage level across the electrodes is above a predetermined threshold voltage (e.g. 180 volts).

Referring now to FIG. 3, a TFEL display 300 includes a display panel 350, top and bottom column drivers 320, 340, and left and right row drivers 310, 330. Operably connected to top column driver 320 are top column electrodes 322-1, 322-2 . . . 322-m which extend almost to the bottom portion of display panel 350. In a similar fashion, operably connected to bottom column driver 340 are multiple bottom column electrodes 342-1, 342-2 . . . 342-m which extend almost to the top of display panel 350.

Left row driver 310 is operably connected to multiple left row electrodes 312-1, 312-2 . . . 312-n which extend almost to the far right hand side of display panel 350. Likewise, right row driver 330 is operably connected to multiple right row electrodes 332-1, 332-2 . . . 332-n which extend almost to the far left hand side of display panel 350.

Connected to each of the row and column drivers is appropriate analog or digital information inputs (not shown) as the case may be.

Figure 5A:
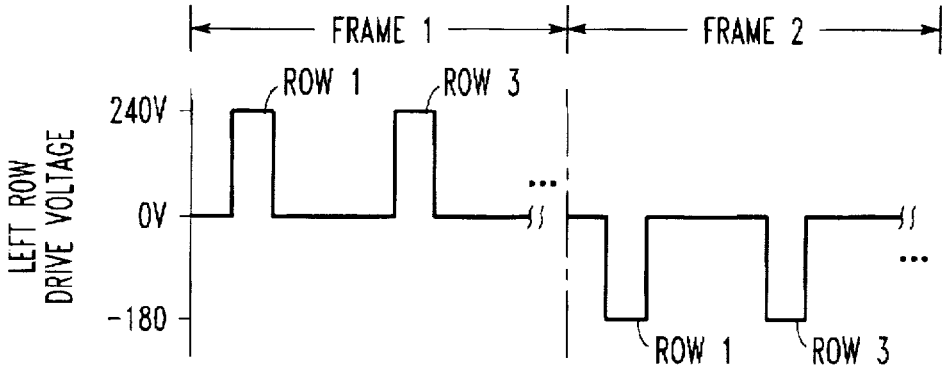
FIGS. 5A–5F are a set of waveforms illustrative of an alternate frame symmetric drive system.
Figure 5B:
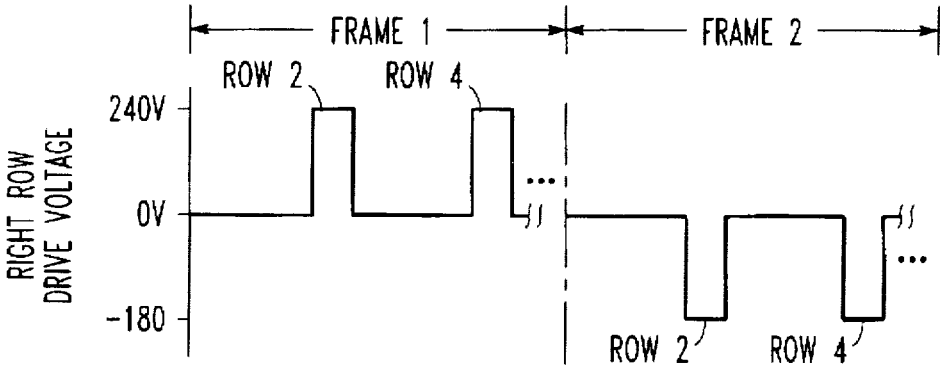
Figure 5C:
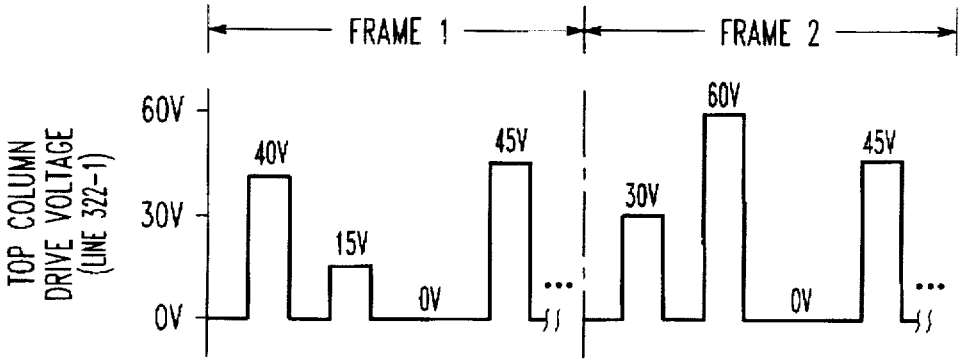
Figure 5D:
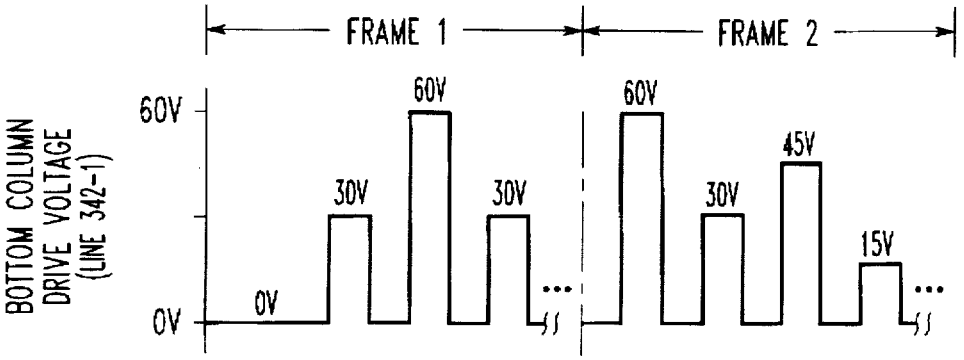
Figure 5E:
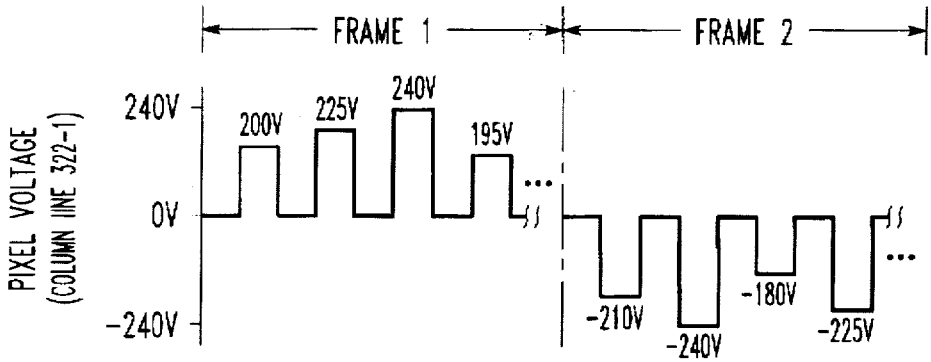
Figure 5F:
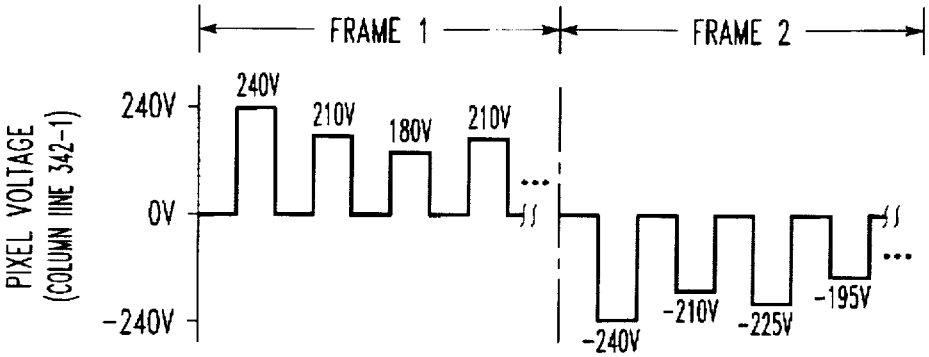
Figure 6A:
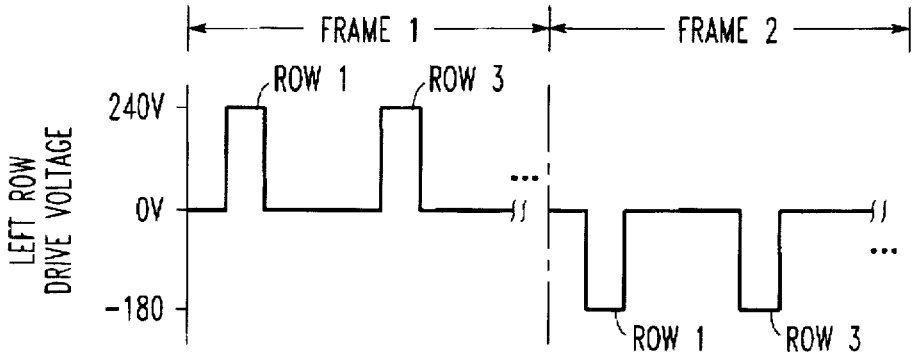
FIGS. 6A–6F are a set of waveforms illustrative of an alternate row symmetric drive system.
Figure 6B:
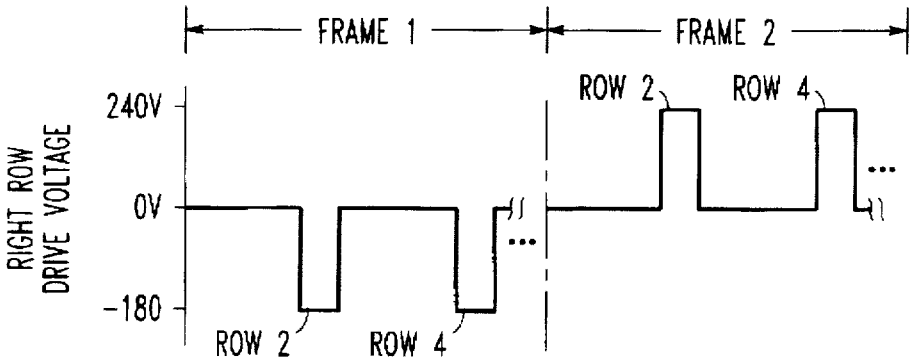
Figure 6C:
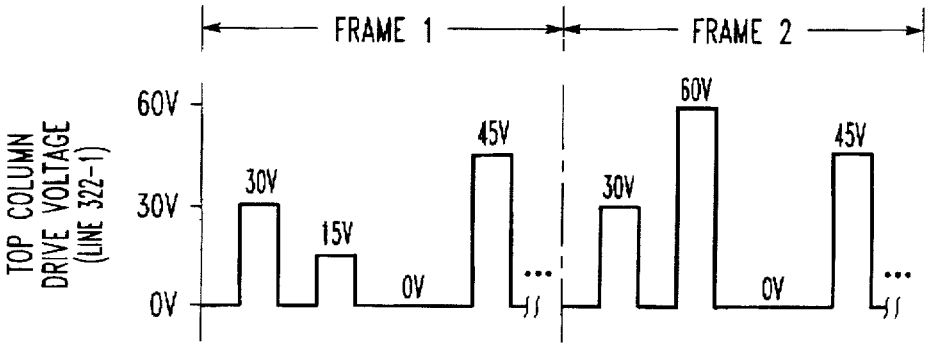
Figure 6D:
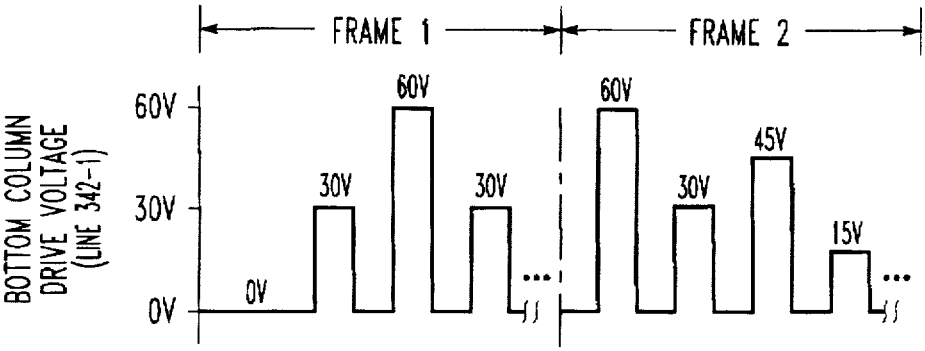
Figure 6E:
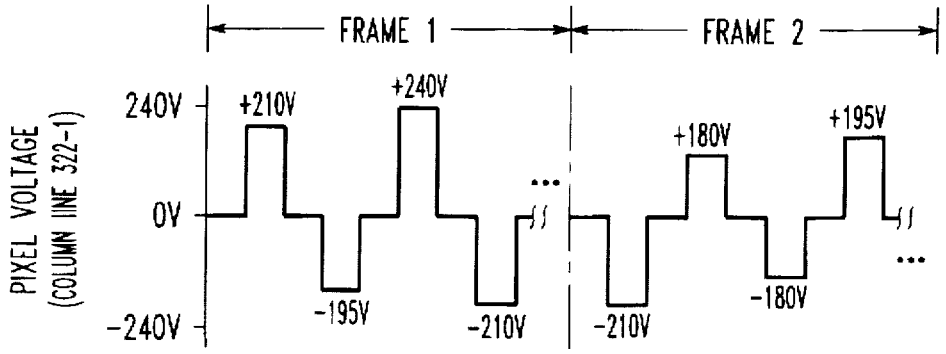
Figure 6F:
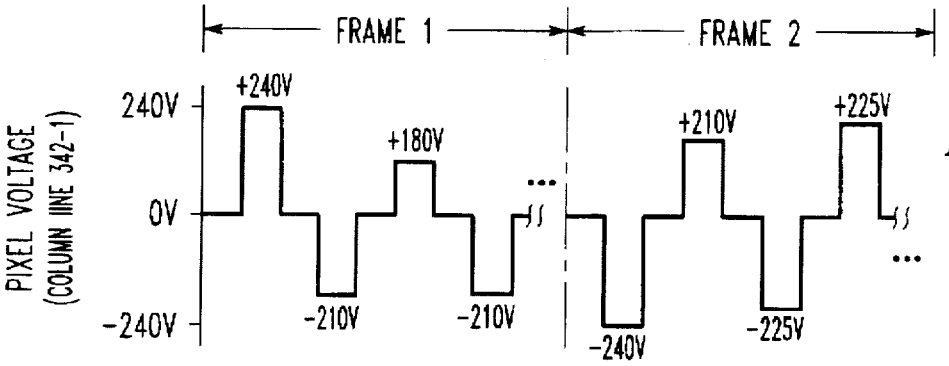

The operation of the TFEL display is as follows and is illustrated in FIGS. 5A–5F and 6A–6F. Left row driver 310 energizes left row electrode 312-1 with a predetermined write voltage, which in this embodiment is alternately either 240 or −180 V. It should be noted that the write voltage and modulation voltages are application specific and are intended to vary across a wide range of voltages according to the type of TFEL display contemplated. A modulation voltage of 0–60 V is applied to top column driver for placement on top column electrode 312-1. The intersection of the row and column electrodes is pixel 352(1,1). Pixel 352(1,1) is illuminated based on the difference between the row voltage of 240 V (FIG. 5A) and the column modulation voltage of 0–60 V (FIG. 5C). If a column modulation voltage of 40 V is applied, for example, then the voltage difference of 240–40=200 V (FIG. 5E) is impressed on pixel 352(1,1) giving a corresponding illumination of the pixel. Modulation voltages are applied in a like manner across the intersection of left row electrode 312-1 and bottom column electrode 342-1, followed by top column electrode 322-2 in an alternating fashion on down the line until top column electrode 322-m illuminates pixel 352(1,y) where y is the sum of the mth and nth column.

Successive rows represented by left row electrode 312-x and right row electrode 332-x, where x=1 to n, are addressed in similar fashion.

Symmetrically driven TFEL display panel 350 can be operated by applying the same polarity write voltage to each row electrode during a single frame and then reversing the polarity of the write voltage in the next frame. Alternatively, symmetrically driven display panel 350 can be operated by providing write voltages that alternate polarity on a row-by-row basis in one frame, and reverse polarities of the applied write voltages in a succeeding frame.

Of course, when the row voltage alternates polarity as described above, the brightness of the pixel depends upon the voltage difference between the row and column electrodes. Therefore the column voltage must be altered, i.e. revolved about an ordinate of 30V, 30V being half way between 0V and 60V. Specifically, and as shown in FIGS. 5A–5F and 6A–6F the column voltage increases from 0 to 60 V when combined with a row voltage of −180 V, and the column voltage then decreases from 60 to 0 V when combined with a row voltage of +240 V in order to provide the same difference voltage which is applied to the individual pixel. For example, if the light emission from a pixel with a +220 V voltage is desired to be the same as when the +40 V modulation voltage is used with a −180 V row voltage, as above, then the modulation voltage of 40 V must be altered (that is, in this embodiment, revolved about an ordinate of 30 V, 30 being half way between 0 and 60) to 20 V in order to generate the same desired intensity. The difference between −180 and 40 is the same as the difference between 240 and 20, – both are 220.

Figure 4A:
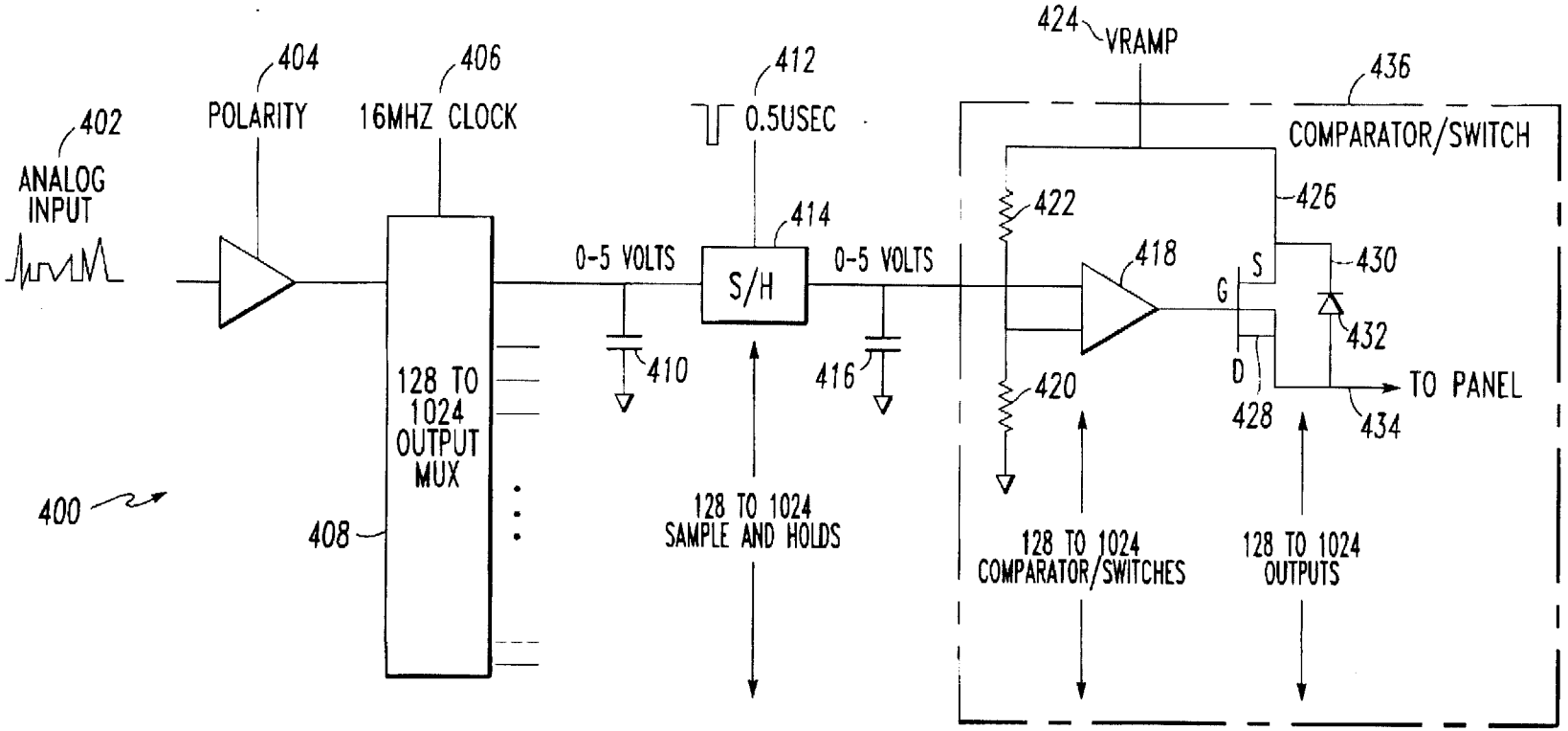
FIG. 4A illustrates a Column Driver of the present invention.

Referring now to FIG. 4A, Column Driver 400 of an embodiment of the present invention includes an analog modulation input 402 connected to polarity inverter 404 for selectively inverting incoming analog modulation input 402. Output multiplexer 408 distributes selectively inverted input 402 to multiple master sample and hold circuits 414 which are connected in a master-slave fashion to slave hold capacitor 416. The sampled and held signal output of capacitor 416 is then input to comparator/switch 436 for output to the electroluminescent display drive panel.

Polarity inverter 404 operates by altering the column driver voltage on successive frames (or alternately on a row-by-row basis) by inverting the magnitude of the analog input signal and adding an equivalent 60 V DC component to bring the resulting waveform to within 0–60 V. The polarity inverter 404 receives a +1 V video input and provides a +2 V output. The video is then selectively inverted. The inverter 404 may be viewed as revolving the waveform around the ordinate (normally x, or independent variable) axis and moving the waveform above the same ordinate axis by an equivalent offset of 60 V.

Output multiplexer 408 operates as a switch selector to distribute the input analog signal 402 among a plurality of column drivers which typically number between 128 and 1024. Typically a VGA output found in current computer displays has 480 rows by 640 columns.

The sample and hold circuitry is of a conventional nature and is not specific to this design. Any suitable design known to those skilled in the art would suffice. The timing for the sample and hold circuitry is provided from an external controller (not shown). The controller determines the sampling at the specific times in a sequential fashion such that the pixel defined by the intersection row 1 and column 1 is fired, followed by row 1, column 2 etc. in a standard interlaced or non-interlaced fashion depending upon the application. In the preferred embodiment, a standard 480 by 640 VGA display technique is used. Alternatively, the well-known NTSC coding scheme could be used. However, any number of additional well known display techniques may be utilized. Alternatively, a capacitor charge coupled device (CCD) array could be used to sample the analog video and then transfer the data to a bank of capacitors to drive the column driver IC outputs.

Comparator/switch 436 includes a comparator 418 connected in series with FET switch 428. A first input of comparator 418 accepts an input from sample and hold circuit 414, while a second input of comparator 418 accepts feedback from the source S electrode of FET 428 through a first feedback loop 426 which includes resistor 422 and an input from external input VRAMP 424.

The output of comparator 418 is input to the gate electrode G of FET 428 which acts as a switch to pass VRAMP 424 voltage to output 434 of comparator/switch 436 and on to display panel 350.

Figure 4B:
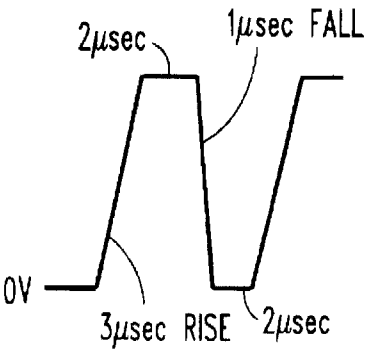
FIG. 4B illustrates a waveforms depiction of the Ramp voltage generated of the present invention.

VRAMP 424 waveform is illustrated in FIG. 4B. It is an analog signal that begins at 0 volts, ramps to 60 volts within 3 μsec, holds steady at 60 V for 2 μsec, ramps down within 1 μsec to 0 V for 2 μsec for a total period of 8 μsec. The waveform then repeats.

Output multiplexer 408 samples the incoming analog video data stream at an appropriate pixel clock rate and stores the sampled video level on hold capacitors 410. Each pixel is stored on a separate capacitor. The multiplexed capacitors are addressed sequentially from the first video pixel. The video level stored is between 0 and 2 V. After the first row horizontal line of video is sampled and stored on capacitor 410, the sample and hold circuits 414 transfer the data to the second bank of capacitors 416. This transfer is conducted during the master/slave horizontal blanking period. A one horizontal line delay is required to pipeline the data so that input multiplexing and output addressing may be performed simultaneously. This pipelining allows the first bank to begin multiplexing and sampling the next row of input analog video in an efficient manner.

The video information stored on capacitors 416 are applied to the TFEL panel column electrodes simultaneously in parallel. Comparators 418 receive the pixel video level on one input which turns on comparator switch 428. An external VRAMP signal is applied to output switches 428 source S input and output 434 start following VRAMP. The comparator/switch 418 provides a voltage translation from +2V input to the 60 V output required by the TFEL panel.

Resistor divider 422 and 420 provide a reduced ramp input to the comparator. The feedback loop provides the switch point for the output video level. When the divided VRAMP voltage 420 reaches the stored voltage level on capacitors 416 the output switch 428 is turned off and the voltage is held at the output by the panel electrode capacitance. An alternate output stage would require another storage capacitor at output 434 with an additional push-pull buffer circuit to drive the panel capacitance. Such an additional buffer circuit would be provided for larger displays with proportionately higher capacitance.

The output voltage is held for the rest of the horizontal period until the external VRAMP returns to 0 V. Diodes 432 are then forward biased and discharge the panel electrodes to 0 V and the cycle is repeated for the next row.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of generating a column voltage for an electroluminescent display panel comprising the steps of:

a) buffering a first analog video signal in a buffer and outputting an intermediate signal, and wherein said buffering step includes, (a1) selectively inverting said first analog video signal on a row-by-row basis or a frame-by-frame basis; and (a2) adding a predetermined DC voltage to said first inverted analog video signal and generating said intermediate output signal therefrom;

b) distributing said intermediate output signal among a predetermined number of means for sampling and holding said intermediate output signal;

c) sampling and holding said intermediate output signal;

d) comparing said intermediate output signal with a signal proportional to a ramp signal ranging between first and second DC voltage magnitudes and outputting a unipolar modulation signal to a display when the amplitude of the signal proportional to the ramp signal equals or exceeds the magnitude of the intermediate output signal.

2. A method of providing a column voltage for an electroluminescent display panel as in claim 1 wherein step d further comprises:

feeding back a signal proportional to the unipolar modulation signal from an output of a comparator to a first input of said comparator together with the signal proportional to the ramp signal and coupling the intermediate output signal to a second input of said comparator.

3. A column driver circuit for generating a modulation signal for an electroluminescent display panel, comprising:

an input buffer coupled to an analog input signal and including a polarity inverter for altering the magnitude of the analog input signal on successive frames or on a row-by-row basis and adding a predetermined DC voltage to the input signal for generating an intermediate output signal for controlling the final generation of a unipolar modulation output signal;

a plurality of sample and hold circuits;

an output multiplexer for coupling the intermediate output signal to said plurality of sample and hold circuits; and a series connected comparator and switch circuit including a signal comparator having first and second inputs for comparing the amplitude of the intermediate output signal from a respective one of said sample and hold circuits applied to said first input with a scaled portion of an externally generated ramp signal from a voltage divider and wherein the externally generated ramp signal varies between a first and a second DC voltage during a predetermined period and being applied to said second input, and generating a control signal when the portion of the scaled ramp signal reaches the level of the intermediate output signal, and a switch device coupled between the externally generated ramp signal and a column electrode of the display panel and being responsive to said control signal from said comparator so as to be turned off thereby to generate a said unipolar modulation output signal of a fixed magnitude ranging between said first and second DC voltage for a period of the ramp signal, said comparator and switch circuit thereby translating the level of the intermediate output signal generated by the input buffer to a unipolar modulation output signal level required by the electroluminescent display panel.

4. A column driver circuit as in claim 3 wherein said switch device comprises a semiconductor switch device including a control electrode and a pair of current conducting electrodes and additionally including a feedback loop for coupling a feedback signal from one of said current conducting electrodes back to said first input of the signal comparator via said voltage divider.

5. A column driver as in claim 3 wherein said first DC voltage is about 0V and said second DC voltage is greater than 0V and additionally including means connected to said switch device for discharging respective panel electrodes when said ramp signal returns to about 0V.

6. A column driver as in claim 5 wherein said means comprises a forward biased diode.

7. A column driver as in claim 4 wherein said semiconductor switch device comprises a transistor.

8. A column driver as in claim 7 wherein said transistor comprises a field effect transistor, said control electrode comprises a gate electrode, one of said pair of current conducting electrodes comprises a source electrode connected to the ramp signal, and wherein the other of said pair of current conducting electrodes comprises a drain electrode connected to said column electrode of the display panel.

9. A column driver as in claim 8 and wherein said feedback loop is coupled from said source electrode back to said first input of the signal comparator.

10. A column driver as in claim 9 and additionally including a panel electrode discharge diode connected between the source and drain electrodes.

* * * * *